US009624749B1

(12) United States Patent
Pruitt et al.

(10) Patent No.: US 9,624,749 B1
(45) Date of Patent: Apr. 18, 2017

(54) CASING STRIPPER DEVICE

(71) Applicants: Grant Pruitt, Fort Smith, AR (US); Cris Braun, Van Buren, AR (US)

(72) Inventors: Grant Pruitt, Fort Smith, AR (US); Cris Braun, Van Buren, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 396 days.

(21) Appl. No.: 14/214,826

(22) Filed: Mar. 15, 2014

Related U.S. Application Data

(60) Provisional application No. 61/801,175, filed on Mar. 15, 2013.

(51) Int. Cl.
*E21B 33/08* (2006.01)

(52) U.S. Cl.
CPC ..... *E21B 33/085* (2013.01)

(58) Field of Classification Search
CPC ..... E21B 33/085; E21B 33/08; E21B 33/06; E21B 19/10
See application file for complete search history.

(56) References Cited

U.S. PATENT DOCUMENTS 2,233,041 A * 2/1941 Alley ..... E21B 33/06 137/498
3,285,352 A * 11/1966 Hunter ..... E21B 33/085 175/214
4,406,333 A * 9/1983 Adams ..... E21B 33/085 166/84.3
4,783,084 A * 11/1988 Biffle ..... E21B 33/085 166/84.3
4,949,796 A * 8/1990 Williams ..... E21B 33/085 175/209
5,647,444 A * 7/1997 Williams ..... E21B 33/085 166/84.1
5,662,181 A * 9/1997 Williams ..... E21B 33/085 166/84.3
7,798,210 B1 * 9/2010 Pruitt ..... E21B 33/085 166/84.1
7,870,896 B1 * 1/2011 Pruitt ..... E21B 33/085 166/83.1
8,905,150 B1 * 12/2014 Pruitt ..... E21B 33/085 166/387
8,991,484 B2 * 3/2015 Riggs ..... F16L 23/10 166/84.1
9,121,249 B1 * 9/2015 Pruitt ..... E21B 33/085
9,267,350 B1 * 2/2016 Pruitt ..... E21B 33/085
2005/0236835 A1 * 10/2005 Williams ..... E21B 33/085 285/361
2013/0020068 A1 * 1/2013 Boyd ..... E21B 33/085 166/84.3

(Continued)

*Primary Examiner* — Jennifer H Gay
(74) *Attorney, Agent, or Firm* — Schrantz Law Firm, PLLC; Stephen D. Schrantz

(57) ABSTRACT

The casing stripper device provides a housing for a stripper rubber that includes a top retainer, a base plate, and at least one rubber disc. A base place is secured within a drilling nipple. At least one disc is secured above the base plate. The number of rubber discs secured between the retainer and base plate will depend on the operation and pressure of the drilling operation. The top retainer is secured to the base plate with at least one rubber disc secured between the top retainer and the base plate.

20 Claims, 23 Drawing Sheets

(56) References Cited

U.S. PATENT DOCUMENTS

| | | | | |
|---|---|---|---|---|
| 2013/0032359 | A1* | 2/2013 | Riggs | F16L 23/10 166/378 |
| 2015/0013994 | A1* | 1/2015 | Bailey | E21B 21/01 166/381 |

* cited by examiner

CASING STRIPPER DEVICE

CROSS-REFERENCE TO RELATED APPLICATIONS

This application claims priority to and is a continuation in part of U.S. Patent Application No. 61/801,175 filed on Mar. 15, 2013 entitled Sealed Grease Head and Top Drive Guide.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

A rotating control device (RCD) in a drilling operation contains fluids and manages pressure for the drilling operation. In certain situations, the drilling rig provides limited space for the drilling operation. In most of these instances, the overhead space above the RCD is limited by the rig providing the rig personnel with limited space to operate.

In known embodiments, a kelly drive attaches to the top of the RCD. The kelly drive rotates the inner barrel of the RCD with the drill string. The attachment of the kelly drive above the inner barrel increases the height of the RCD. The increased height of the kelly drive attached to the RCD limits the space above the RCD which is needed by rig personnel. Removal of the kelly drive assists the rig personnel with the operation of the rig by providing additional operating room for the rig personnel.

The removal of the kelly drive reduces the height of the RCD by at least three inches, approximately four inches. However, removal of the kelly drive exposes the inner barrel to potential damage. The top drive guide of the present invention creates a lower profile RCD by decreasing the overall height of the RCD by approximately four inches by removing the kelly drive unit. The top drive guide also protects the inner barrel while stabbing the inner barrel and rubber with the mandrel. Furthermore, the top drive guide is installed and removed rather easily. It also eliminates the need to weld a hard face on the driver surface.

The present invention also provides a sealed grease head with two separate grease compartments. Grease installed in the grease compartments lubricate the bearings and the seals to assist with operation of the RCD. The improved grease compartments provide sufficient grease to an upper bearing and a lower bearing. The two separate compartments separate the upper bearing and the lower bearing to provide a distinct compartment for the upper bearing. This separated compartment stores sufficient grease to be applied to the upper bearing without travelling downward for use with the lower bearing.

The present invention also provides an improved stripper rubber that reduces the costs and manufacture of stripper rubbers. The present invention provides a housing for a stripper rubber that includes a top retainer, a base plate, and at least one rubber disc. The disc is secured between the retainer and base plate. The number of rubber discs secured between the retainer and base plate will depend on the operation and pressure of the drilling operation.

SUMMARY OF THE INVENTION

In the known art, a kelly driver attaches above the RCD for rotation of the inner barrel with the drill string. However, the attachment of the kelly drive increases the height of the RCD. The top guide drive of the present invention eliminates the need for the kelly drive, thus creating additional work space above the RCD.

The top drive guide assists with insertion of the drill string through the inner barrel and a rubber found in the RCD. The top drive guide aligns the drill string with the inner barrel and rubber for insertion through the inner barrel and the rubber. The top drive guide positions the drill string within the rubber for rotation of the inner barrel with the drill string. The contact of the drill string with the rubber caused by the top drive guide rotates the inner barrel with the drill string. The top drive guide may be used either in a low pressure head or a high pressure head.

The present invention also provides a sealed grease head that provides two grease compartments, an upper grease compartment and a lower grease compartment. Each grease compartment is sealed by a top seal and a bottom seal. These grease compartments are located at the bearings between the inner barrel and outer barrel of the RCD. A grease inlet for each grease compartment allows the user to apply grease to the grease compartment. The grease flows to the bearings and seals to assist with the rotation of the inner barrel.

The present invention also provides a new casing stripper rubber that replaces stripper rubbers. The stripper rubber of the present invention decreases the costs of manufacturing the known stripper rubbers. The casing stripper rubber of the present invention utilizes rubber discs installed between a retainer and base plate. The retainer, rubber discs, and base plate are then installed into a nipple. Retention fingers on the nipple prevent the retainer, rubber discs, and base plate from passing through the nipple and into the hole.

It is an object of the present invention to provide rig personnel with additional room for operating the rig.

It is a further object of the present invention to decrease the overall height of the RCD.

It is a further object of the present invention to protect the inner barrel.

It is a further object of the present invention to eliminate the need for a kelly driver.

It is a further object of the present invention to use the sealing element of the RCD to grip the drill string to rotate the RCD.

It is a further object of the present invention to provide two grease compartments for lubricating the bearings and the seals of the RCD.

It is a further object of the present invention to eliminate and/or reduce grease from expanding through the seals and out of the compartments.

It is another object of the present invention to separate the upper bearing from the lower bearing to provide sufficient grease to the upper bearing.

Another object of the present invention is to allow larger drilling tools, down hole tools, and casing to pass through the attachment body and casing stripper.

Another object of the present invention is to maintain grease within the grease compartments.

Another object of the present invention is to create a safer work environment for rig personnel.

Another object of the present invention is to provide a larger bore size that enables rig operators to run larger size bits in the hole. Frequently large drill bits are pulled up into the RCD while stripping out of the well that become stuck in the RCD bore. These stuck drill bits increase down time on the rig increasing the drilling costs to the driller. These stuck drill bits also create higher refurbishing costs to the manufacturer to remove the stuck bit from the equipment.

Another object of the present invention is to lower drilling costs.

Another object of the present invention is to reduce downtime of the drilling operation.

It is another object of the present invention to reduce the costs of stripper rubbers.

In addition to the features and advantages of the sealed grease head and the top drive guide according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

In well drilling, with a rotary drilling rig, the drill bit and drilling pipe receive rotary motion from power equipment located on the surface. Below the drilling floor, at the ground surface, there is usually an assembly known as a rotating head that circulates various fluids used in the drilling. The present invention relates to rotating heads for oil and gas wells and more particularly, to an improved rotating head that enables the ease of use for the end user.

Figure 1:
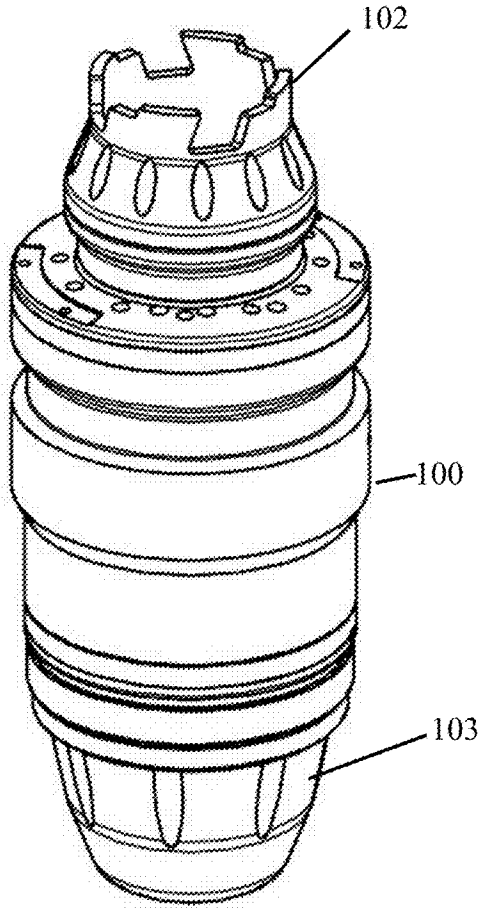
FIG. 1 is an environmental view of one embodiment of the present invention.

FIG. 1 shows an RCD 100 with a kelly driver 102 attached at the top of the RCD 100. In the known art, the kelly driver receives the rotary motion from the power equipment described above. The kelly driver increases the height of the RCD to receive this rotary motion from the power equipment.

Figure 2:
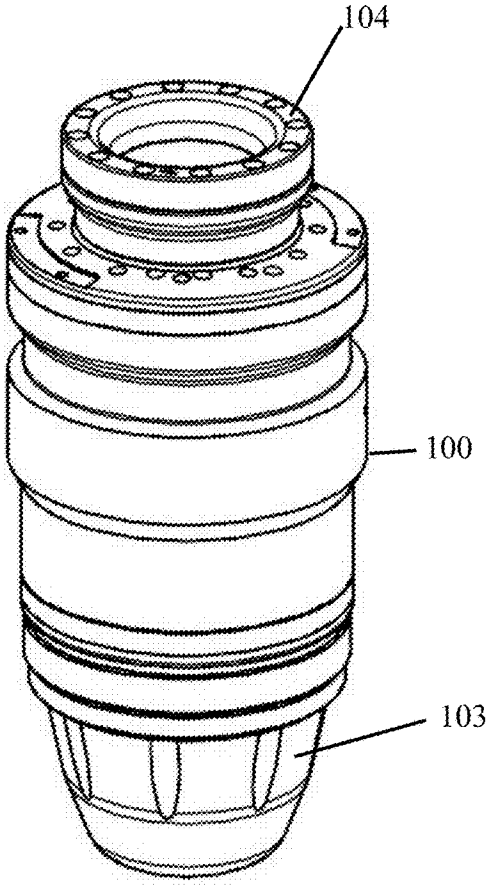
FIG. 2 is an environmental view of one embodiment of the present invention.

FIG. 2 shows an RCD 100 with a top drive guide 104 attached at the top of the RCD 100. FIGS. 1 and 2 show a side by side comparison of the increased height of the RCD 100 created by the kelly drive 102. The top drive guide 104 reduces the overall height of the RCD thus creating additional overhead space for the rig personnel.

FIGS. 1 and 2 show rubber 103 that is located on the RCD 100. The rubber 103 seals the drilling string. A drilling string is inserted or "stabbed" through the rotating head assembly, including the one or two rubbers 103 rotatably mounted in the rotating head assembly, to seal the drilling string.

Figure 3:
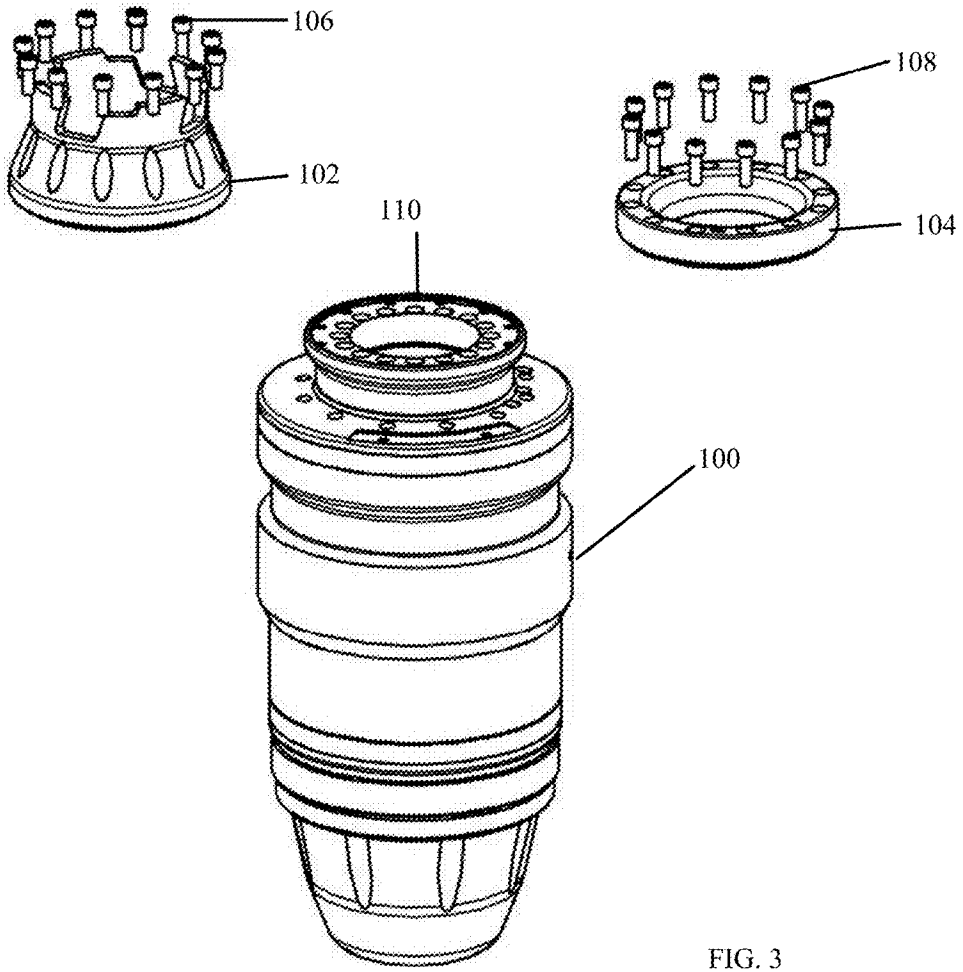
FIG. 3 is an environmental view of one embodiment of the present invention

FIG. 3 shows the attachment of the kelly drive 102 or the top drive guide 104 to the inner barrel 110 of the RCD 100. In one embodiment, the kelly drive 102 or the top drive guide 104 are attached to the inner barrel 110 by fasteners 106, 108. In one embodiment, the top drive guide 104 is bolted to the inner barrel 110 by bolts. Other known fasteners may attach the top drive guide 104 to the inner barrel 110.

FIG. 2 shows the top drive guide 102 attached to the top of the inner barrel 110. The top drive guide 102 protects the inner barrel 110 while stabbing the mandrel through the inner barrel 110. The attachment of the top drive guide 102 by fasteners 108 enables the users to quickly and easily attach and remove the top drive guide 102.

Figure 4:
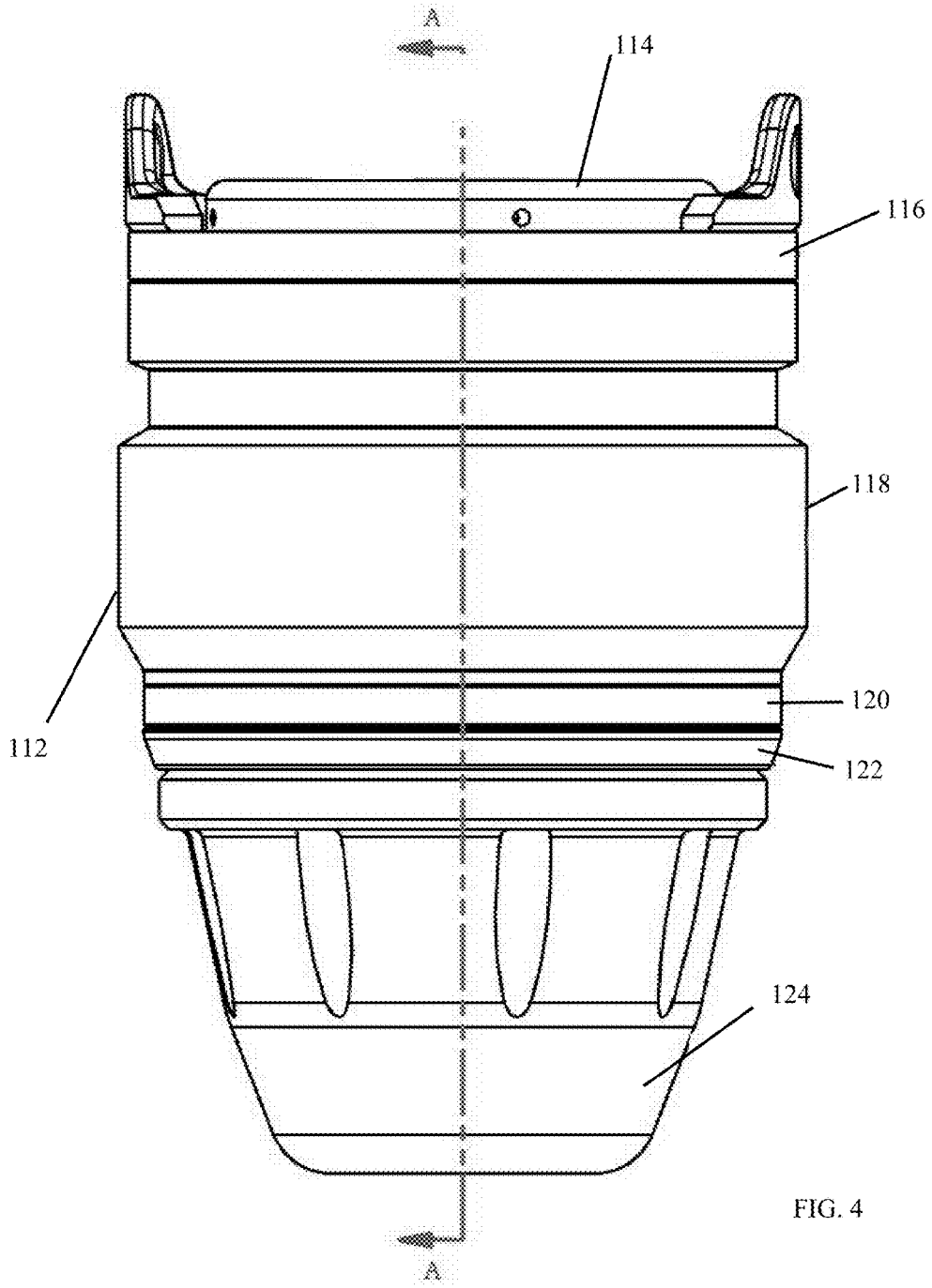
FIG. 4 is an environmental view of one embodiment of the present invention.

FIG. 4 shows the sealed grease head 112 of the present invention and another embodiment of the top drive guide 114. Referring to FIGS. 4-8, the top drive guide 114 installs to the inner barrel through fasteners attached at fastener apertures 134. In one embodiment, the fastener apertures 134 may be set screw holes. Four fastener apertures 134 located along the side wall of the top drive guide 114 enable attachment of the top drive guide 114 to the inner barrel. The larger bore 130 of the top drive guide allows larger drill bits to be used down hole. Lip 136 found within bore 130 provides additional clearance between the inner barrel and the outer barrel 118.

The top drive guide 114 also provides an O-ring groove 132 for installing an O-ring to seal the head. The O-ring seals the head to limit debris from entering the head.

Figure 5:
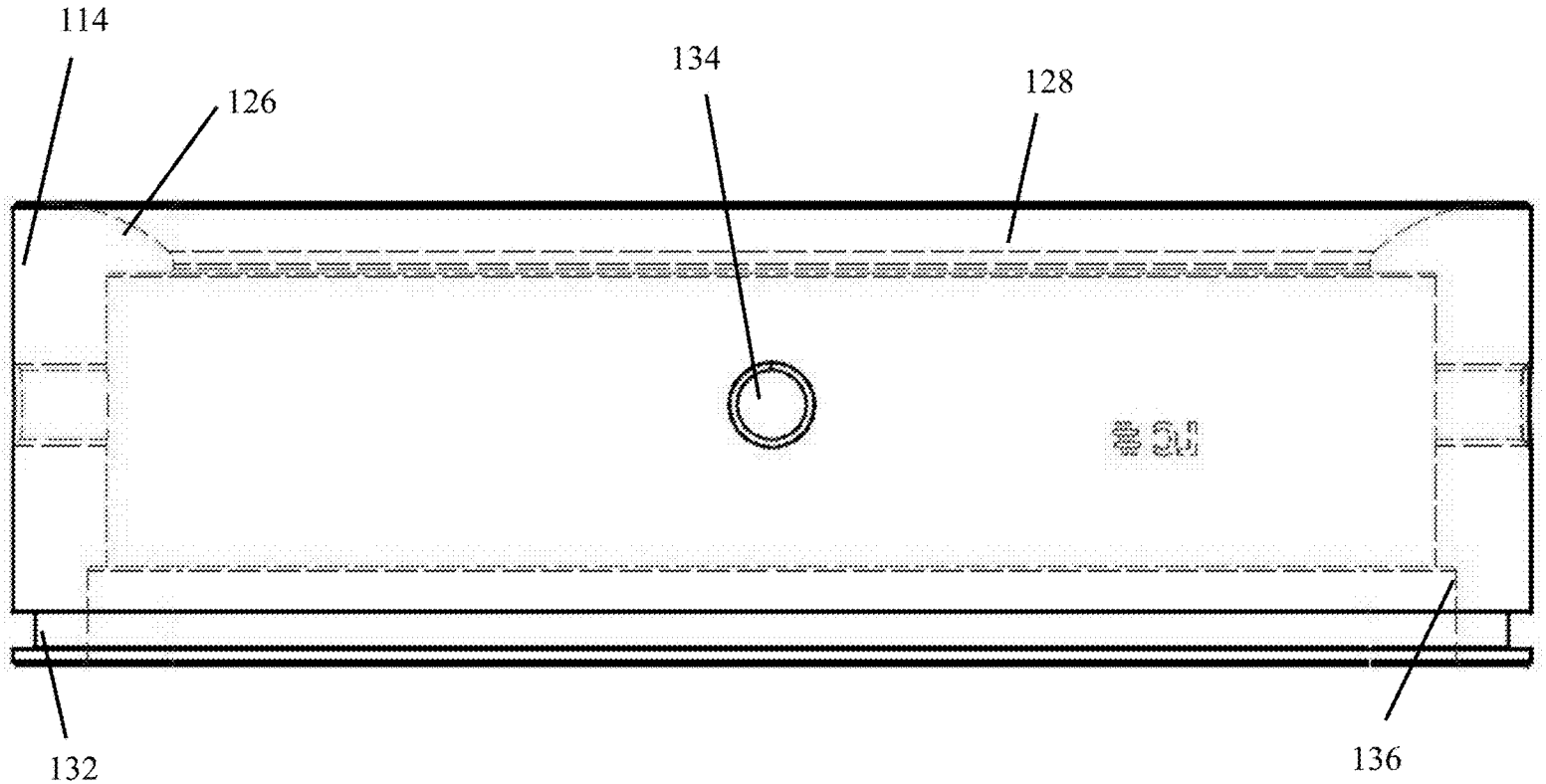
FIG. 5 is a sectional view of a top drive guide of one embodiment of the present invention.
Figure 6:
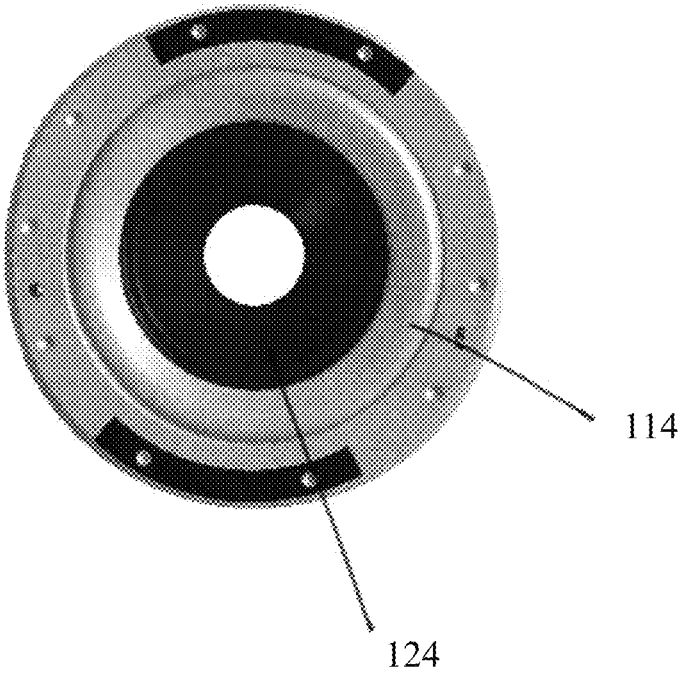
FIG. 6 is a top environmental view thereof.
Figure 7:
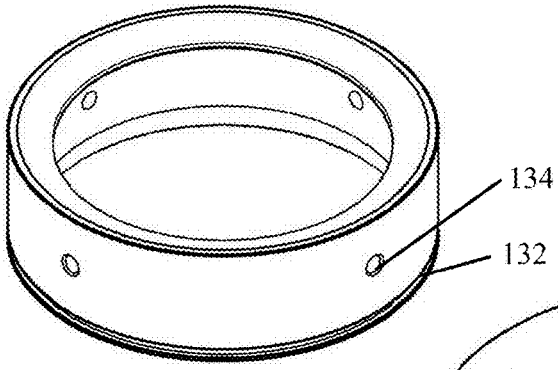
FIG. 7 is a top perspective view of a top drive guide of one embodiment of the present invention.
Figure 8:
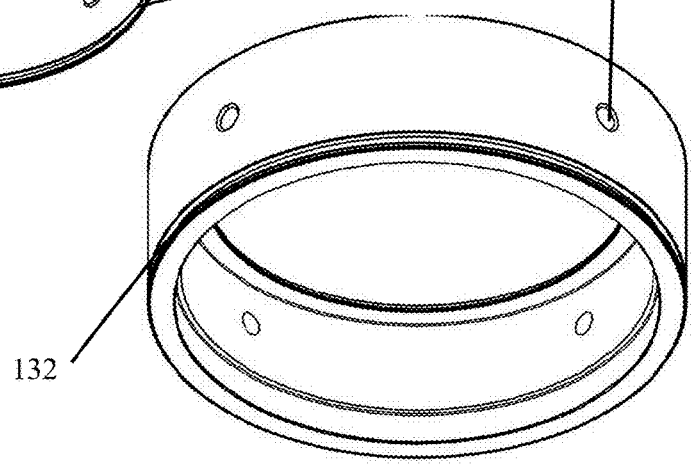
FIG. 8 is a bottom perspective view thereof.

Guide finger 126 located along the upper interior of the top drive guide 114 shown in FIG. 5 will now be described in more detail. Referring to FIG. 5, the guide finger 126 directs the mandrel towards bore 130. The guide finger 126 angles inward down towards the bore 130. As the mandrel is inserted into the aperture 128 of the top drive guide 114, the guide finger 126 directs the mandrel downwards to the bore 130 as shown in FIG. 6.

The drill string passes through the top drive guide 114 and into the bore 130. The drill string is then stabbed through the rubber 124. As discussed above, the contact of the drill string with the rubber 124 rotates the inner barrel with the drill string.

Referring to FIGS. 4 and 9-12, the sealed grease head 112 of the present invention will now be described in more detail. The sealed grease head 112 creates two sealed grease compartments for lubricating the seals and the bearings. The sealed grease head utilizes three different seals, a top seal 138, a middle seal 144, and a bottom seal 150. The top seal 138 is located within top seal carrier 116. Similarly, the bottom seal 150 is located within bottom seal carrier 120.

The rubber 124 attaches to the head 112. The rubber 124 secures to the rubber adapter 122 that attaches to the inner barrel 136. The rubber 124 seals around the drill string when the drill string is stabbed through the rubber 124. The contact of rubber 124 with drill string causes the rubber 124 to rotate with the drill string. As a result, the rotation of the drill string also rotates the inner barrel 136 due to the attachment of rubber 124 with rubber adapter 122 and inner barrel 136.

Figure 9:
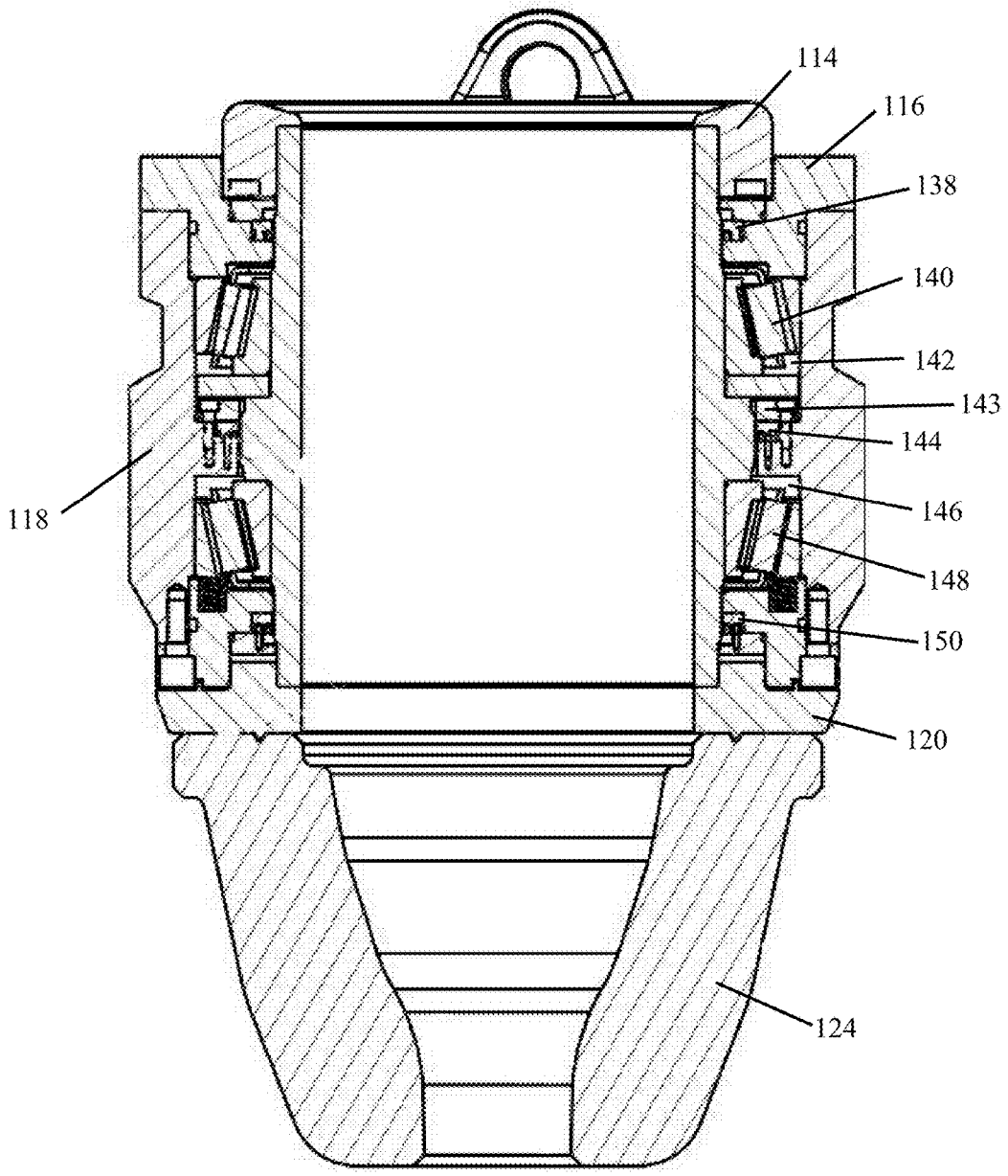
FIG. 9 is a sectional view of one embodiment of the present invention.

Referring to FIG. 9, the grease compartments 142, 146 store lubrication to be applied to the bearings 140, 158 located between the outer barrel 118 and the inner barrel 136. The top seal 138 and middle seal 144 form the upper grease compartment 142. The middle seal 144 and the bottom seal 150 form the lower grease compartment 146.

The top seal carrier 116 attaches to the outer barrel 118 for sealing the upper grease compartment 142. The top seal carrier 116 places the top seal 138 adjacent the top seal surface 156. The top seal carrier 116 may be machined to place the top seal 138 at different locations on the top seal surface 156. In another embodiment, the top seal carrier may not be machined to adjust the location of the top seal. The contact between the top seal 138 and the top seal surface 156 seals the upper grease compartment 142. In one embodiment, the top seal is secured to the top seal carrier by a fastener, including but not limited to a dowel pin. The attachment of the top seal to the top seal carrier and the outer barrel enables the top seal to remain fixed with the outer barrel.

The middle seal 144 is mounted in the bore of the outer barrel 118. The middle seal 144 is located between the upper grease compartment 142 and the lower grease compartment 146. The middle seal 144 serves as a seal for both the upper grease compartment and the lower grease compartment. The middle seal 144 serves to seal the bottom of the upper grease compartment 142 and serves to seal the top of the lower grease compartment 146. The middle seal 144 may be mounted on different locations in the bore of the outer barrel to increase the contact area with the middle seal surface 158 on the inner barrel. In one embodiment, the middle seal is secured to a retaining plate by a fastener, including but not limited to a dowel pin. The attachment of the middle seal to the retainer plate and the outer barrel enables the middle seal to remain fixed with the outer barrel.

The bottom seal carrier 120 attaches to the outer barrel 118 for sealing the lower grease compartment 146. The bottom seal carrier 120 places the bottom seal 150 adjacent the bottom seal surface 160. The bottom seal carrier 120 may be machined to place the bottom seal 150 at different locations on the bottom seal surface 160. In another embodiment, the bottom seal carrier may not be machined to adjust the location of the bottom seal. The contact between the bottom seal 150 and the bottom seal surface 160 seals the lower grease compartment 146. In one embodiment, the bottom seal is secured to the bottom seal carrier by a fastener, including but not limited to a dowel pin. The attachment of the bottom seal to the bottom seal carrier and the outer barrel enables the bottom seal to remain fixed with the outer barrel.

In one embodiment, the top seal, bottom seal, and middle seal are secured to the outer barrel. The top seal, bottom seal, and middle seal in such an embodiment do not rotate with the inner barrel. Instead, the top seal, bottom seal, and middle seal remain fixed with the outer barrel.

Figure 10:
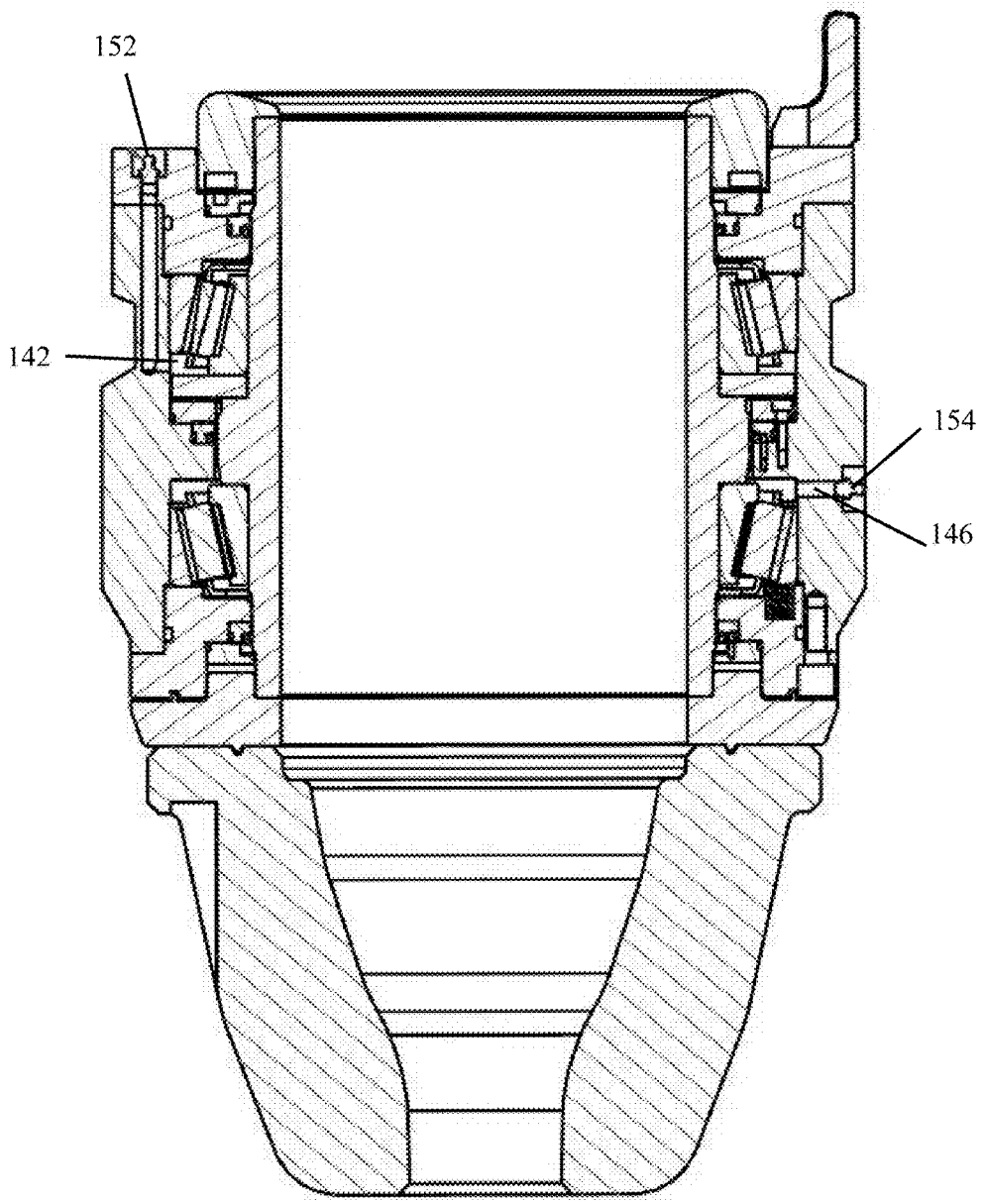
FIG. 10 is a sectional view of one embodiment of the present invention.

FIG. 10 shows the grease inlets 152, 154 for applying the grease to the grease compartments 142, 146. Separate inlets provide grease to its respective compartment. Upper grease inlet 152 supplies upper grease compartment 142 with grease. Lower grease inlet 154 supplies lower grease compartment 146 with grease.

The sealed grease head 112 provides lubrication to bearings 140, 148 in addition to top seal 138, bottom seal 150, and middle seal 144. Grease expands to approximately 30% above initial volume as it heats up. The internal pressure also increases as temperature increases. "Thickeners" in the grease release oil as the temperature rises.

In one embodiment, the grease compartments 142, 146 are filled to ⅔ capacity with grease. The initial fill of grease covers the bearings 140, 148 located in the grease compartments 142, 146. If the grease compartments 142, 146 are completely filled with grease prior to use, as the head heats up under normal operating parameters, grease will be forced out of the seals which would not be permissible.

Each grease compartment 142, 146 is filled to ⅔ capacity with grease to increase bearing life and bearing lubrication. A coating of grease is also applied to the upper top seal 138 prior to operation as lubrication is required for each seal to function as designed. As the head 112 heats up under normal use, the grease expands to lube the top seal 138.

The larger bore size of the grease head 112 allows rig operators to run larger size bits in the hole. Frequently, large drill bits are pulled up into the RCD while stripping the bits out of the well. These bits may then become lodged in the RCD bore. This causes down time on the rig and higher drilling cost to the driller. This also causes higher refurbishing costs to the manufacturer required by removal of the bit from the equipment. The nine inch bore of one embodiment of the present invention alleviates many of the problems associated with smaller bore equipment.

Figure 11:
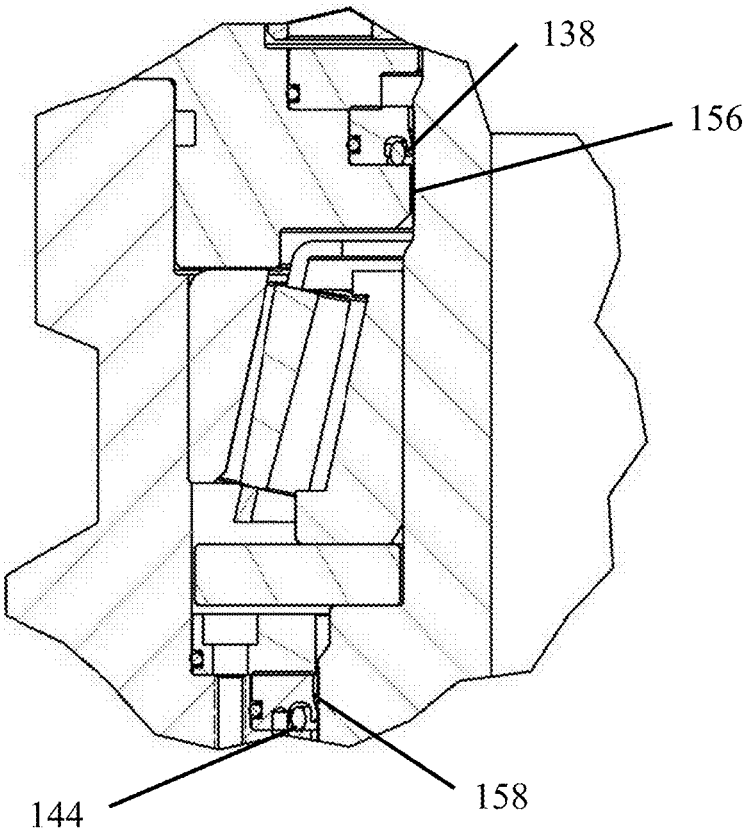
FIG. 11 is a sectional view of a portion thereof.
Figure 12:
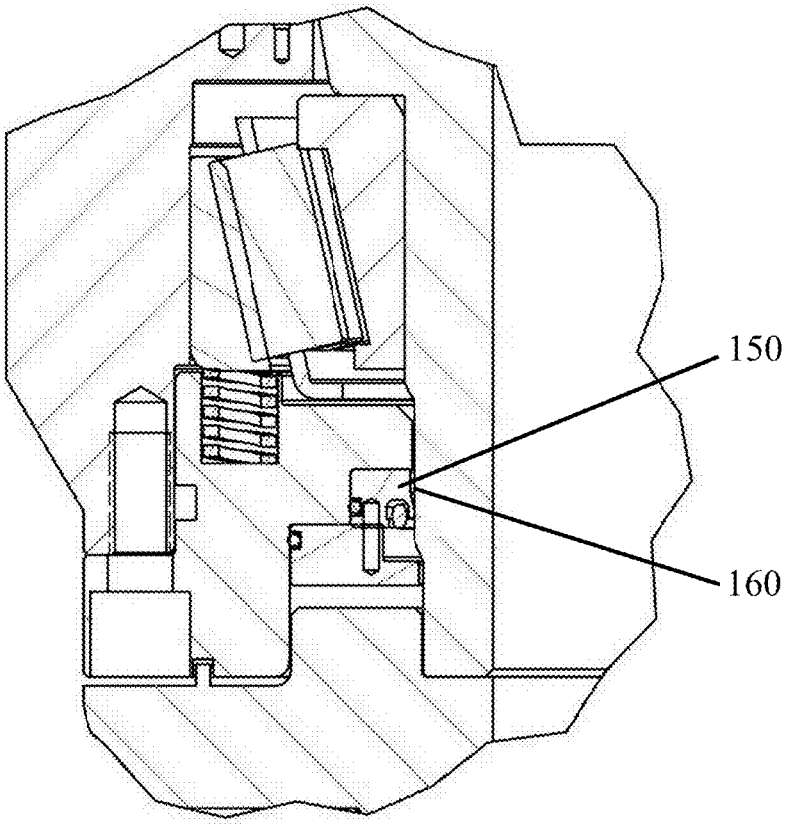
FIG. 12 is a sectional view of a portion thereof.
Figure 13:
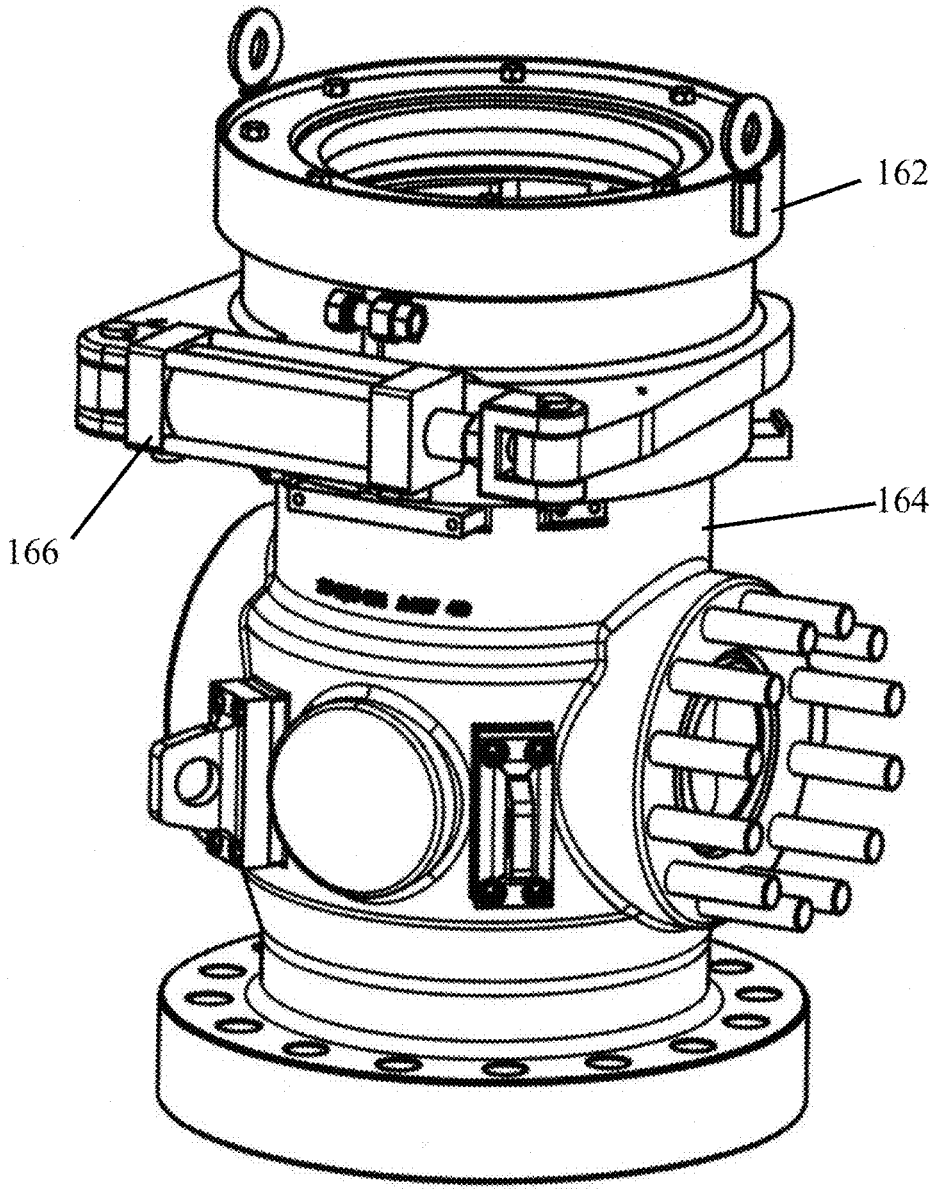
FIG. 13 is an environmental view of one embodiment of the present invention.
Figure 14:
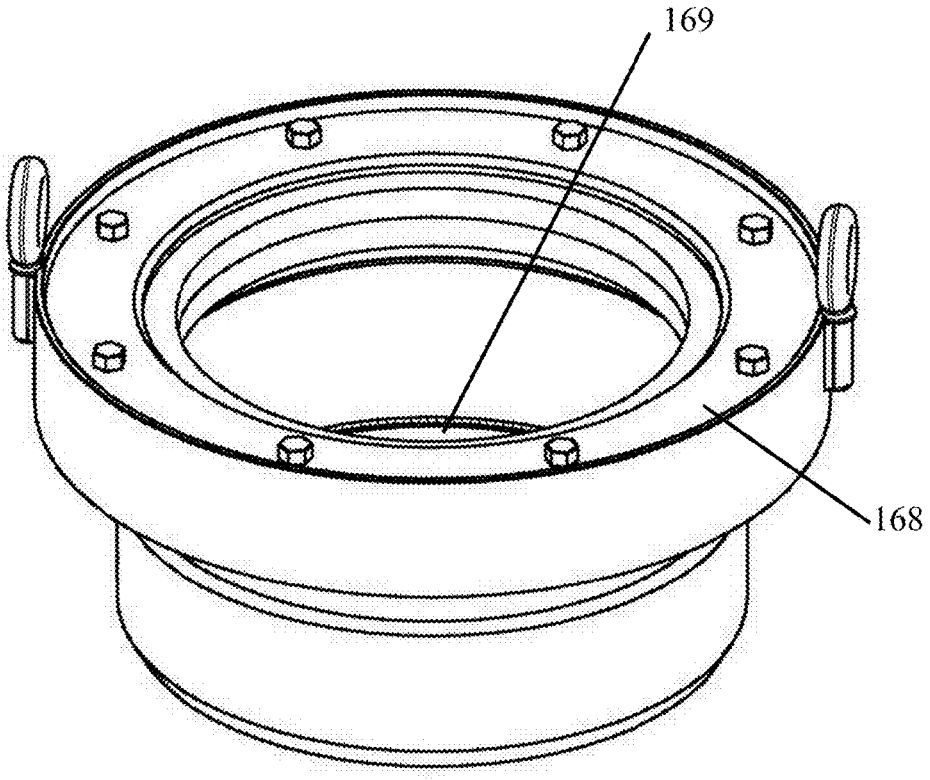
FIG. 14 is an environmental view of one embodiment of the present invention.

FIGS. 11 and 12 show the contact between the seals 138, 144, 150 and the seal surfaces 156, 158, 160. These seals 138, 144, 150 are located at seal cavities within the seal carriers 116, 120. Middle seal 144 is mounted in the bore of the outer barrel 118. A retainer plate 143 is secured to the outer barrel 118. In one embodiment, the retainer plate 143 is bolted to the outer barrel 118. Another fastener, including but not limited to a dowel pin, secures the middle seal 144 to the retainer plate 143.

Each seal 138, 144, 150 contacts a seal surface 156, 158, 160. Each seal surface may be constructed from a tungsten sleeve attached to the inner barrel 136. As the seal surface 156, 158, 160 wears, the seal cavity may be machined again to place the seal 138, 144, 150 at a new location to wear a new area of the seal surface. Each seal contacts its own seal surface. Top seal 138 contacts top seal surface 156. Middle seal 144 contacts middle seal surface 158. Bottom seal 150 contacts bottom seal surface 160.

As the seal surface 156, 158, 160 is depleted, the user may replace the seal surface by attaching a new seal surface on the inner barrel 136. The attachment of a new seal surface allows for a longer life of the inner barrel 136 thus reducing costs and waste.

FIGS. 13-17 show different embodiments of the casing stripper rubber of the present invention. In one embodiment, the casing stripper rubber is used in low pressure RCDs. The casing stripper rubber 162, 168, 170, 172 attaches to the RCD for placement in the bowl 164. A clamp 166 then secures the RCD within the bowl 164. Referring to FIGS. 17-21, the casing stripper rubber 162, 168, 170, 172 is available in many different sizes as required by the specific drilling operation and equipment at the drilling site. For example, the casing stripper 168, 170, 172 is available with inner apertures of 16 inches, 18.625 inches, and 20 inches. The casing strippers 168, 170, 172 are sized for 7 and 1/16 inches to 30 inch bowls.

Figure 15:
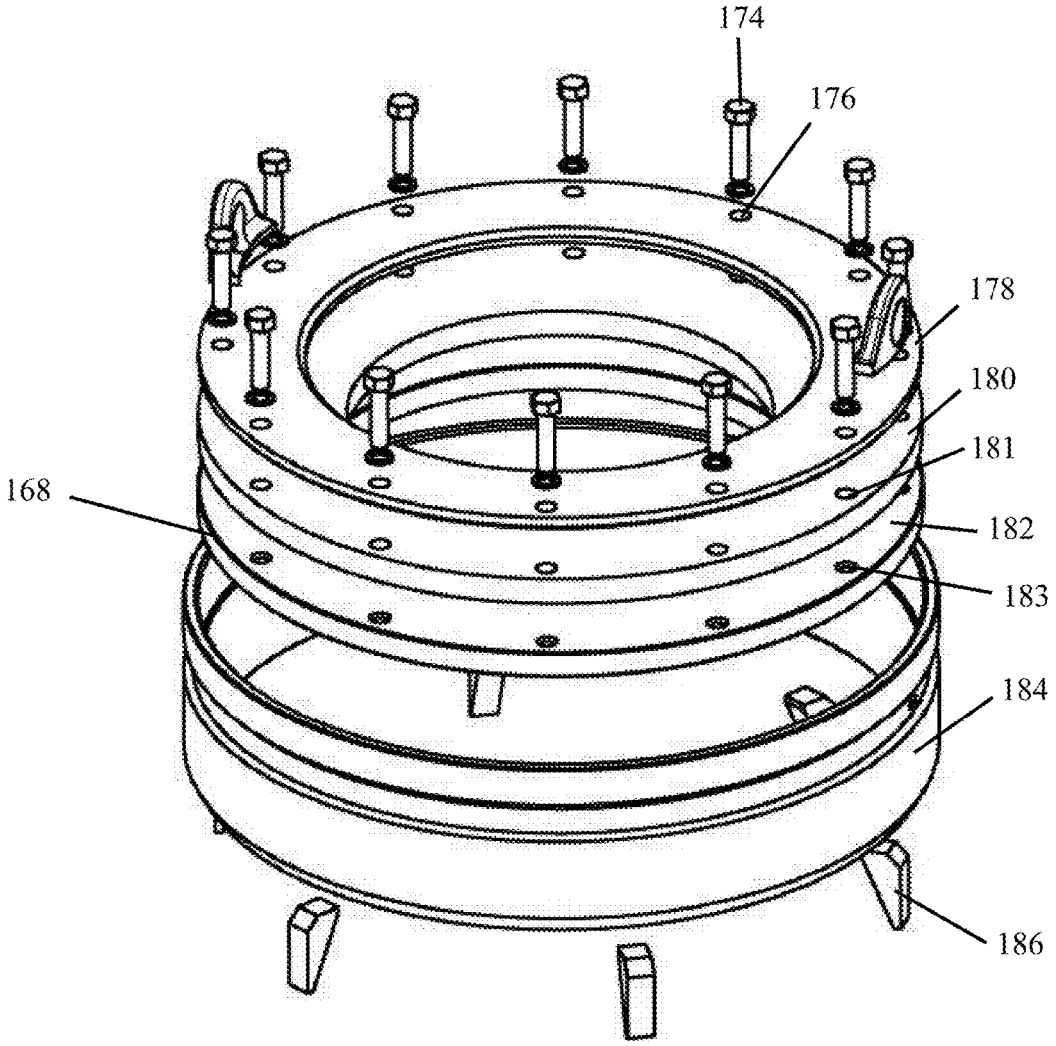
FIG. 15 is an exploded view thereof.
Figure 16:
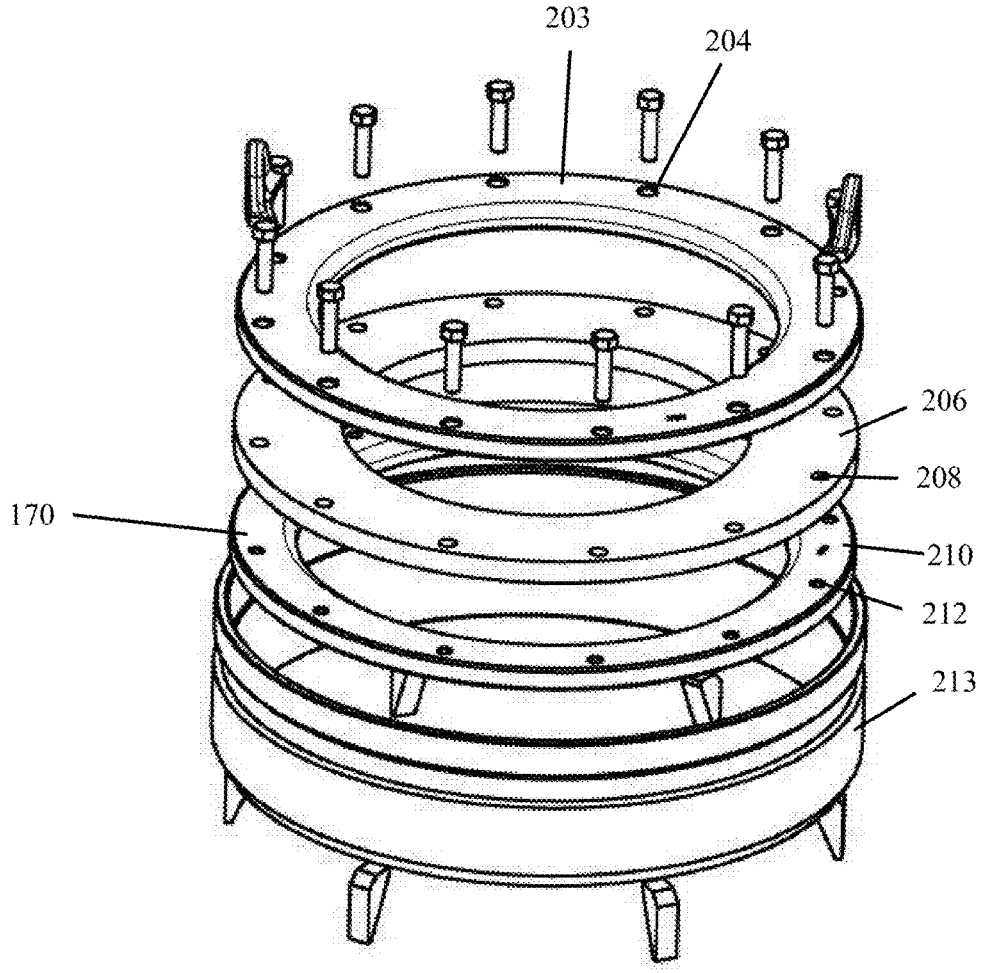
FIG. 16 is an exploded view of one embodiment of the present invention.
Figure 17:
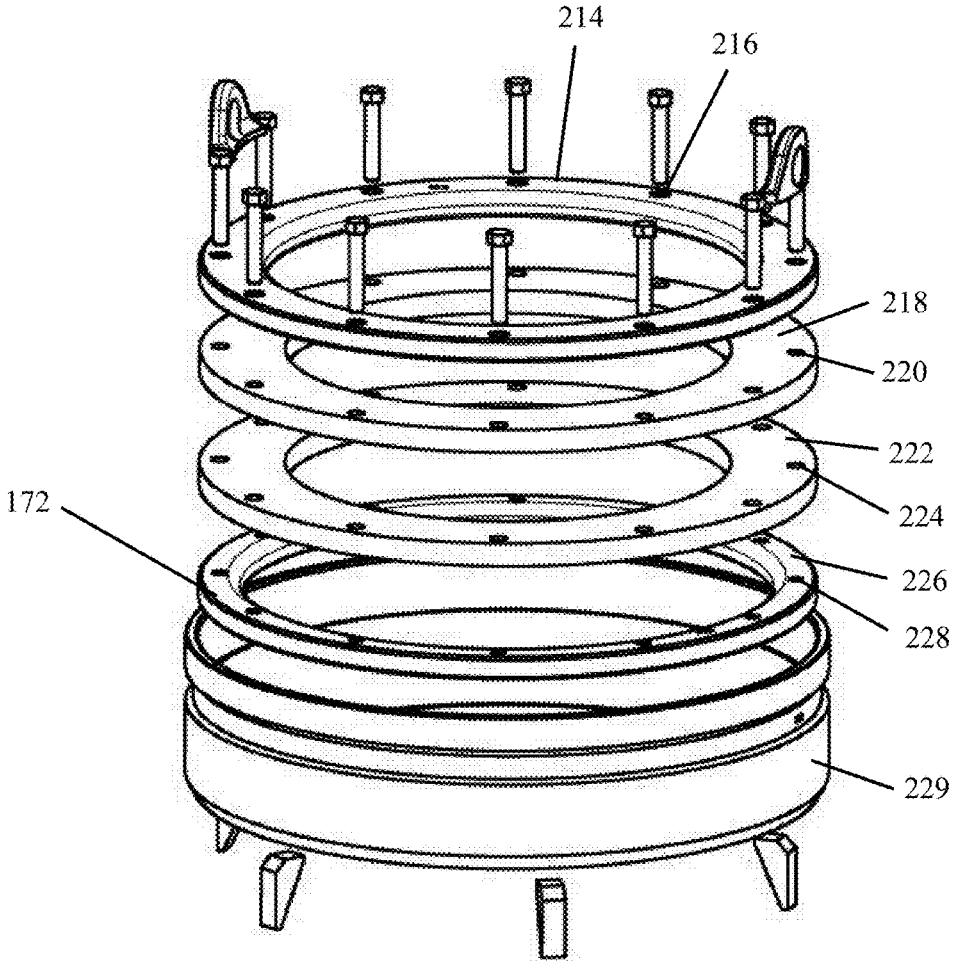
FIG. 17 is an exploded view of one embodiment of the present invention.
Figure 18:
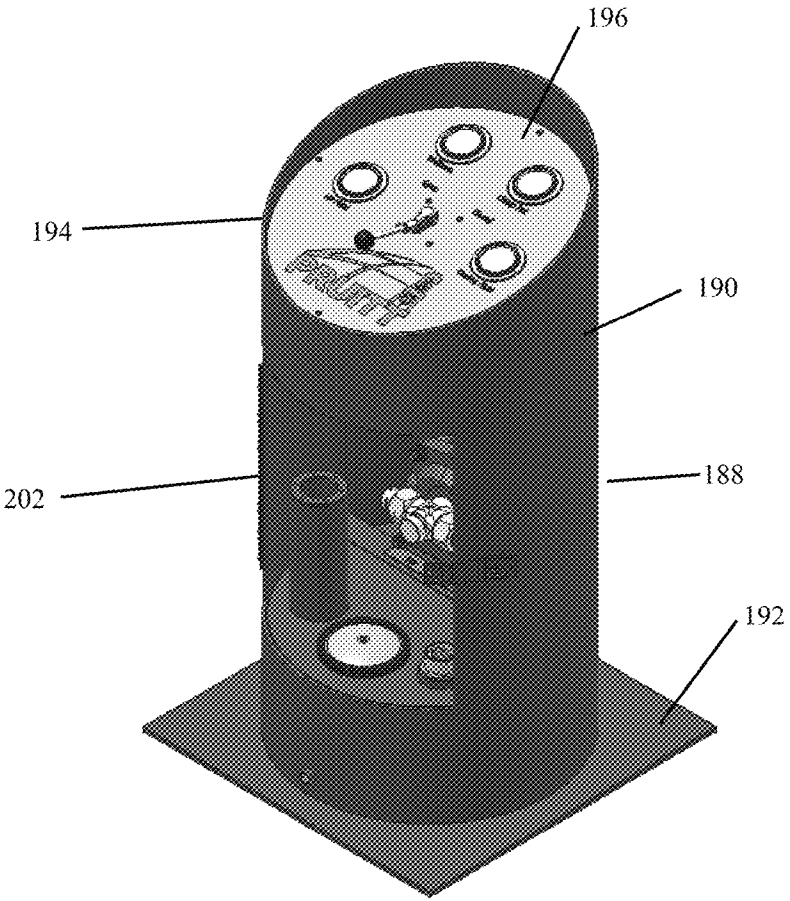
FIG. 18 is a top perspective view of a clamp station of one embodiment of the present invention.
Figure 19:
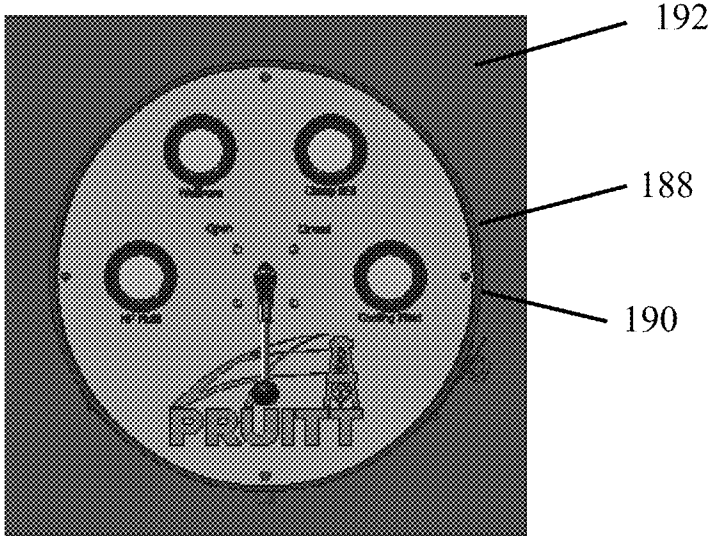
FIG. 19 is a top view thereof.
Figure 20:
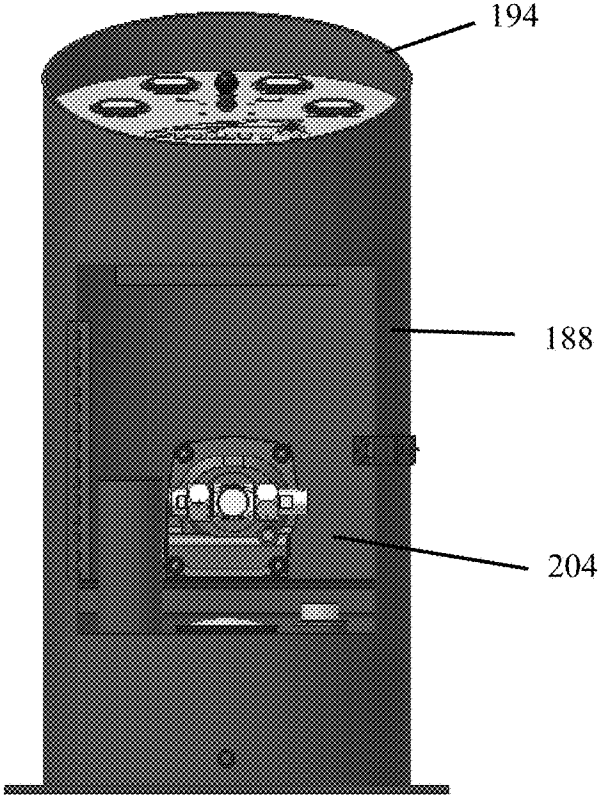
FIG. 20 is a front view thereof.
Figure 21:
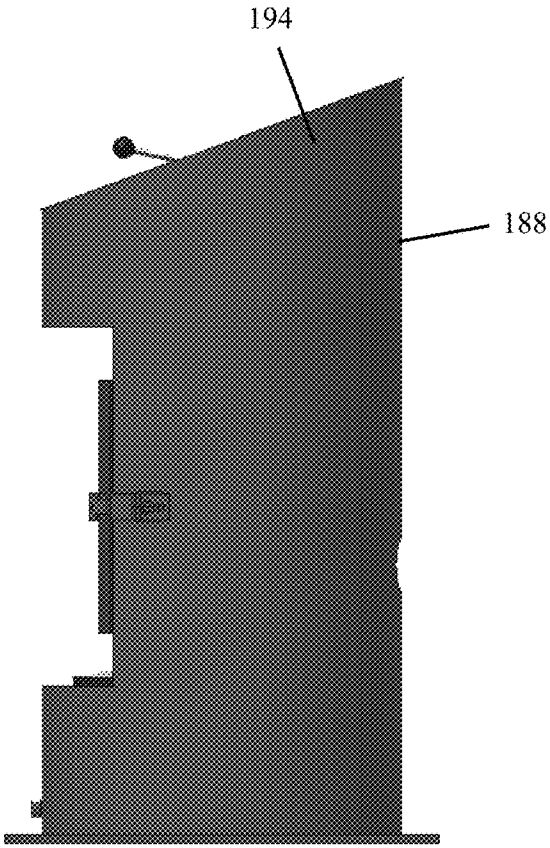
FIG. 21 is a right side view thereof.

FIGS. 15-17 provide additional information regarding the casing stripper rubber. At least one rubber disc 180, 206 as shown in FIGS. 15 and 16 is placed between retainer 178, 203 and a base plate 182, 210. In an embodiment shown in FIG. 17, two rubber discs 218, 222 or more are inserted between the retainer 214 and the base plate 226. The base plates and retainers are constructed from a rigid material, including but not limited to metal, to prevent the rubber discs from being forced down hole.

Fasteners 174 are installed into apertures 176, 204, 216 of the retainer 178, 203, 214, apertures 181, 208, 220, 224 of a rubber disc 180, 206, 218, 222, and apertures 183, 212, 228 of base plate 182, 210, 226 to secure the stripper rubber 168, 170, 172 within the nipple 184, 213, 229. Support fingers 186 located at the interior portion of the nipple 184, 213, 229 prevent the retainer 178, 203, 214, rubber discs 180, 206, 218, 222 and base plate 182, 210, 226 from being forced down hole. The support fingers 186 extend inward from the nipple 184, 213, 228 into the nipple aperture formed by the nipple. In one embodiment, the support fingers 186 are sized not to pass into the inner aperture of the corresponding retainer and base plate. By stopping short of the inner aperture, the support fingers 186 do not interfere with placing tools, casing, etc. down hole.

The support fingers 186 and base plates 184, 210, 226 are secured with the nipple 184, 213, 228. In one embodiment, the support fingers 186 and base plates 184, 210, 226 are welded to the nipple 184, 213, 228. The base plate may also be secured to the support fingers by welding the base plate to the nipple and the support fingers. The size of the nipple is selected according to the bowl. The outer wall of the nipple should be sized sufficiently large enough to form an inner aperture 169 sized to allow the casing and any other tools to pass down hole.

Each of the retainers 178, 203, 214; base plates 184, 210, 226; nipples 184, 213, 228; and rubber discs 180, 206, 218, 222 define an inner aperture sized to allow casing and other tools to be inserted down hole. The size of the inner aperture will be sized for the bore for which the stripper rubber is to be used. The outer wall of the retainers 178, 203, 214; base plates 184, 210, 226; and rubber discs 180, 206, 218, 222 will be sized according to the nipples 184, 213, 228.

To create the seal, the disk aperture of the rubber disks is sized smaller than the nipple aperture, the base aperture, and the retainer aperture. In one embodiment, the disk aperture has a smaller diameter than the diameter of the nipple aperture, the diameter of the base aperture, and the diameter of the retainer aperture. The rubber disk when secured with the base, the nipple, and the retainer extends horizontally inward into the inner aperture. Therefore, at least a portion of the rubber disk protrudes horizontally interior of the nipple aperture, the base aperture, and the retainer aperture.

In one embodiment, the retainers and base plates are secured to at least one rubber disc. Fasteners, such as bolts, screws, or other fasteners, secure the retainer, base plate, and rubber discs together. The apertures 216, 220, 224, 228, for example, are aligned with one another. The fasteners are installed into the apertures securing the base plate, the top retainer, and the rubber discs. In the embodiment in which the base plate is secured to the drilling nipple, the fasteners secure the top retainer and rubber discs with the base plate and the nipple to secure the stripper rubber within the nipple.

FIGS. 18-23 show a clamp station 188 designed for bilateral use in that the basic frame can be made into either a Low Pressure or High Pressure clamp station. The clamp station 188 utilizes application-specific components that are interchangeable such that the clamp station is built to suit from the base frame up.

Figure 22:
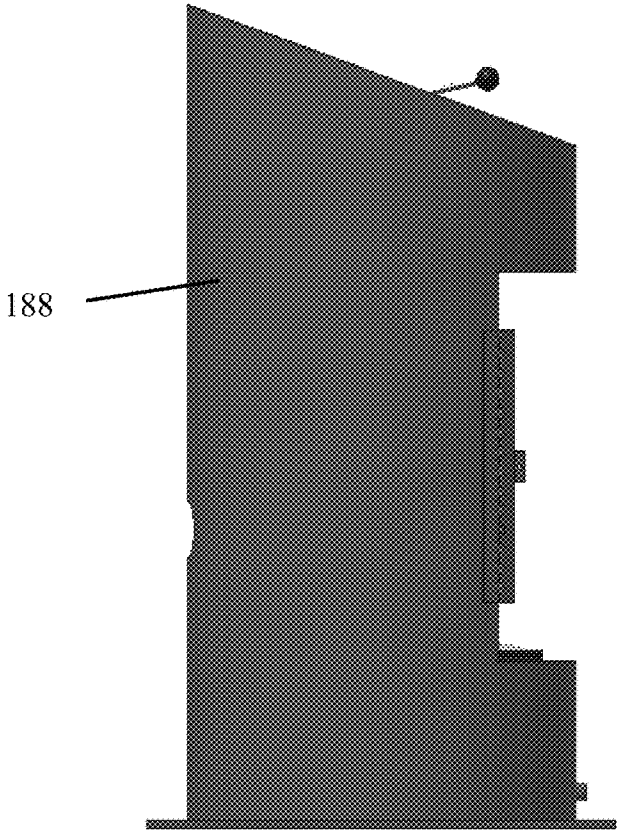
FIG. 22 is a left side view thereof.
Figure 23:
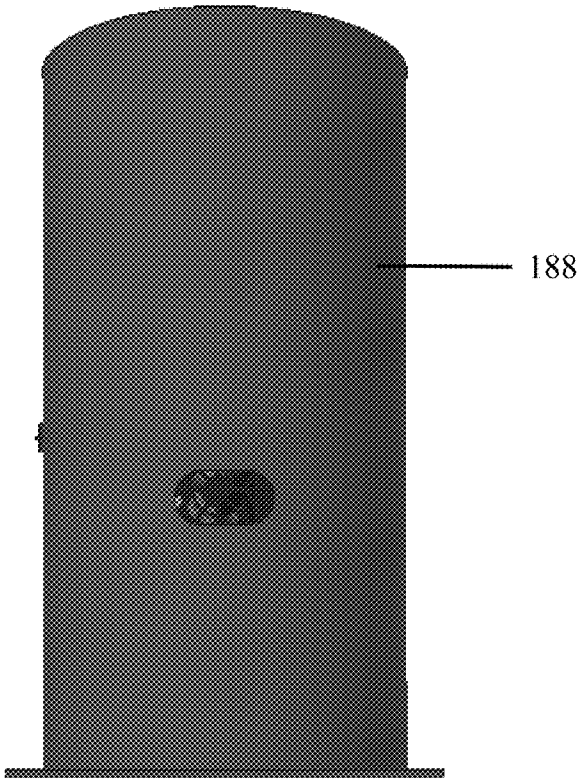
FIG. 23 is a rear view thereof.

The body 190 of the clamp station 188 is a 20" OD steel pipe (Body) with ¼" wall thickness and, lastly, the base 190 of this body is welded to a 24"×24"×⅜" steel base plate 192 (base). The top 194 of the body 190 is cut at an angle of 21 degrees (front is 34"—and back is 42"—from the base). This angled top 194 allows for the installation of a stainless steel gauge plate 196 that is either made for a HP or LP application. FIG. 22 shows a HP gauge plate and pump. When the angled cut is made in the source pipe, it creates the top faces 194 of two clamp station bodies 190. The source pipe is then square cut a distance of 42" from the angle cut (on the long side) to create a second clamp station body. This process minimizes wasted source pipe material by optimizing the 20' standard length of pipe.

The gauge plate 196 is installed at an angle of 14 degrees (34" in front and 39" in back—from the base), which causes the gauges and manual hydraulic valve to be below the elevation of the body's side-wall. This difference in elevation allows for retainer straps to be used during transportation and avoid contacting either the gauges or the valve. The clamp station 188 may also use two lift-eyes welded to both sides of the top of the body 190 that serve as lifting points as well as providing a holding location for the retainer straps as shown in FIG. 28. FIG. 28 shows an image of the low pressure clamp station. The lift eyes may be implemented on both the high pressure clamp station and the low pressure clamp station.

The door 202 to the clamp station 188 is fabricated by cutting the left side of the door and welding a hinge in place over this first cut. The other three sides of the door are then cut to free the door from the body. Door stops are then welded in to prevent the door from swinging inside the body.

Figure 24:
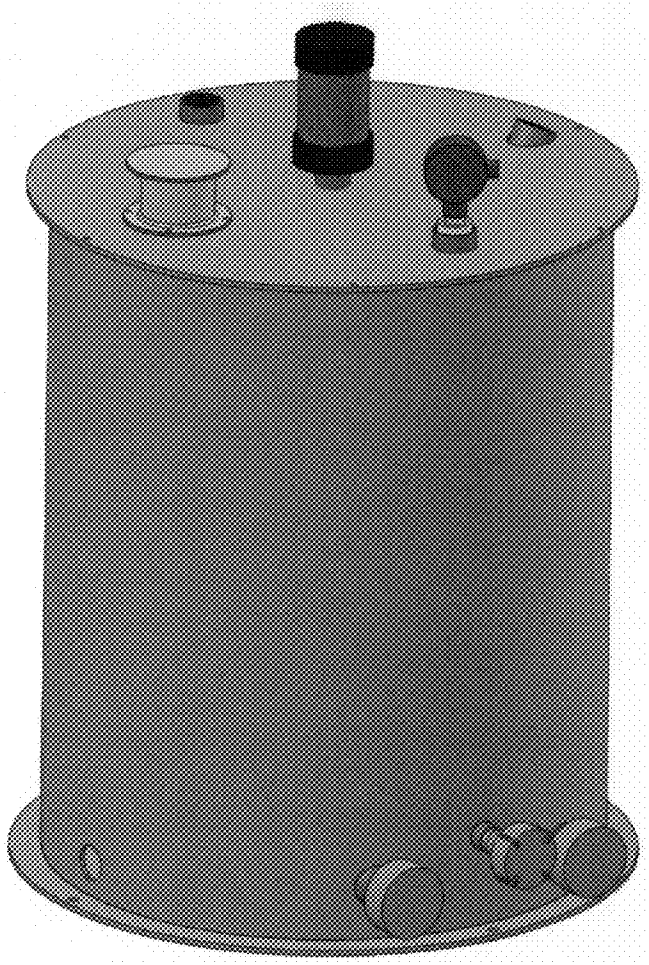
FIG. 24 is a top perspective view of a clamp station of one embodiment of the present invention.
Figure 25:
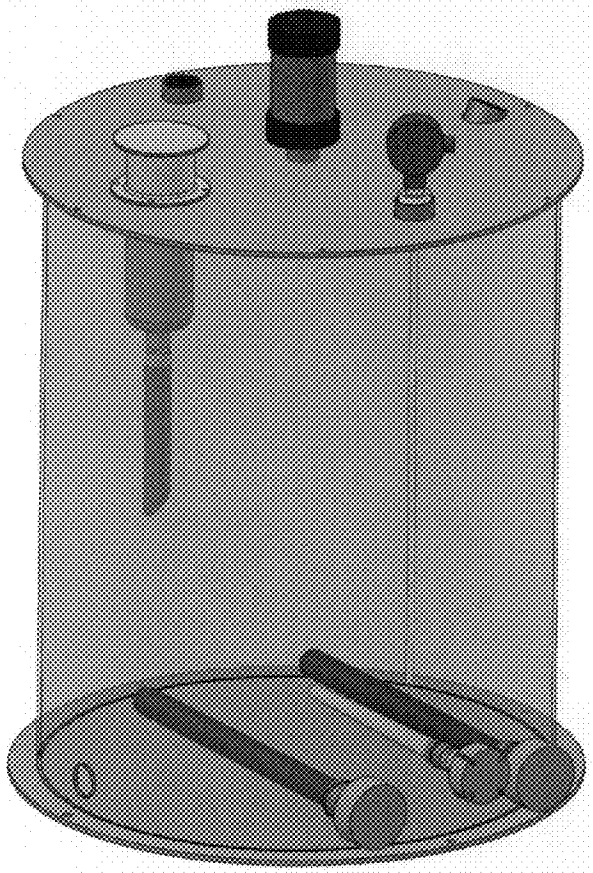
FIG. 25 is a partial view thereof.

The internal tank 204 is created when a round, ¼" plate (tank lid) is welded in at a distance of 8" above the bottom of the body, serving as the top to the eight gallon tank. This tank lid is cut specifically to have a series of pipe couplings welded in it to create a liquid-tight space and allow for the tank to be plumbed for outbound and inbound hydraulic oil as shown in FIGS. 24 and 25. There is also a hole in the tank lid where a clean-out cover is installed that allows for any future tank maintenance that may be required. Not shown in the attached drawing is a vented fill cap that will be installed on the top of the 8" fill pipe located in the front-left space of the tank lid. The component in the front-right space of the tank lid is a sealed gauge that shows the fullness of the tank.

Inside the body cavity are hard-mounted pneumatic and hydraulic components that create the plumbing system. The list of these components is specific to either the high- or low-pressure application of its intended use.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A stripper rubber device to be secured to a bowl for running casing through the device along a vertical axis, the device comprising:

a base constructed from a rigid material, the base defining a base aperture;

a retainer top constructed from a rigid material, the retainer top attachable to the base wherein the retainer top attaches vertically above the base;

a drilling nipple having an outer wall, the base secured to the drilling nipple wherein the outer wall is located horizontally exterior of an outermost surface of the base, wherein the outer wall of the drilling nipple extends vertically above the base; and at least one rubber disk secured between the retainer top and the base wherein the rubber disk is located horizontally interior of the outer wall and above the base when the rubber disk is secured between the retainer top and the base.

2. The device of claim 1 wherein the inner wall defines a nipple aperture, the base secured to the inner wall of the drilling nipple wherein the retainer top, rubber disk, and base are secured within the drilling nipple.

3. The device of claim 2 further comprising:

a support finger secured to the inner wall of the drilling nipple wherein the support finger extends inward from the inner wall of the drilling nipple into the nipple aperture, the support finger securing the base inwardly of the outer wall of the drilling nipple.

4. The device of claim 3 wherein the base is secured to the drilling nipple and the support fingers.

5. The device of claim 1 wherein the rubber disk secures to the base and the retainer top.

6. The device of claim 5 further comprising:

a disk aperture located interior of the rubber disk; and a retainer aperture located interior of the retainer top wherein the retainer aperture, the disk aperture, and the base aperture are at least partially aligned when the rubber disk is secured to the base and the retainer top.

7. The device of claim 1 further comprising:

a fastener aperture of the retainer top;

a fastener aperture of the base;

a fastener aperture of the rubber disk wherein the fastener aperture of the retainer top aligns with the fastener aperture of the base and aligns with the fastener aperture of the rubber disk; and a fastener placed into the fastener aperture of the rubber disk, the fastener aperture of the retainer top, and the fastener aperture of the rubber disk when aligned to secure the retainer top with the base and the rubber disk.

8. The device of claim 1 wherein the size of the retainer aperture, the disk aperture, and the base aperture are dependent upon the size of the casing to be run through the stripper rubber device.

9. The device of claim 1 wherein an inner edge of the rubber disk extends horizontally interior of an inner edge of the base and an inner edge of the retainer top.

10. The device of claim 1 further comprising:

the base defining a base aperture encompassed by the base;

the retainer top defining a retainer aperture encompassed by the retainer top; and the rubber disk defining a disk aperture encompassed by the rubber disk wherein the disk aperture is smaller than the base aperture.

11. The device of claim 1 further comprising:

the base defining a base aperture encompassed by the base;

the retainer top defining a retainer aperture encompassed by the retainer top; and the rubber disk defining a disk aperture encompassed by the rubber disk wherein the disk aperture is smaller than the retainer aperture.

12. A stripper rubber device to be secured to a bowl for running casing, the device comprising:

a base constructed from a rigid material, the base defining a base aperture encompassed by the base;

a retainer top constructed from a rigid material, the retainer top attachable to the base, the retainer top defining a retainer aperture encompassed by the retainer top; and at least one rubber disk secured between the retainer top and the base, the rubber disk defining a disk aperture encompassed by the rubber disk wherein the disk aperture is smaller than the base aperture.

13. The device of claim 12 wherein the base aperture is located interior of an inner edge of the base; the retainer aperture is located interior of an inner edge of the retainer top; and the disk aperture located interior of an inner edge of the rubber disk;

wherein the inner edge of the rubber disk extends horizontally interior of the inner edge of the base and the inner edge of the retainer top when the rubber disk is secured to the top retainer and the base.

14. The device of claim 12 wherein the disk aperture is smaller than the base aperture and the retainer aperture.

15. The device of claim 14 wherein the diameter of the disk aperture is smaller than the diameter of the base aperture and the diameter of the retainer aperture.

16. The device of claim 12 further comprising:

a drilling nipple;

an inner wall of the drilling nipple wherein the interior wall defines a nipple aperture, the base secured to the interior wall of the drilling nipple wherein the retainer top, rubber disk, and base are secured within the drilling nipple.

17. The device of claim 16 further comprising:

a support finger secured to the inner wall of the drilling nipple wherein the support finger extends inward from the inner wall of the drilling nipple into the nipple aperture wherein the base is secured to the drilling nipple and the support fingers.

18. A stripper rubber device to be secured to a bowl for running casing through the device along a vertical axis, the device comprising:

a base constructed from a rigid material, the base defining a base aperture encompassed by the base wherein the base aperture is located interior of an inner edge of the base;

a retainer top constructed from a rigid material, the retainer top attachable to the base, the retainer top defining a retainer aperture encompassed by the retainer top wherein the retainer aperture is located interior of an inner edge of the retainer top;

at least one rubber disk secured between the retainer top and the base, the rubber disk defining a disk aperture encompassed by the rubber disk wherein the disk aperture is located interior of an inner edge of the rubber disk;

wherein the rubber disk extends inwardly beyond an inner edge of the base and an inner edge of the retainer top when the rubber disk is secured to the top retainer and the base.

19. The device of claim 18 wherein the disk aperture is smaller than the retainer aperture.

20. The device of claim 19 further comprising:

a support finger secured to an inner wall of a drilling nipple wherein the support finger extends inward from the inner wall of the drilling nipple into a nipple aperture wherein the base is secured to the drilling nipple and the support finger.

* * * * *